US009481163B2

(12) United States Patent
Zlatin et al.

(10) Patent No.: US 9,481,163 B2
(45) Date of Patent: Nov. 1, 2016

(54) VARIABLE CUTOFF ALIGNMENT APPARATUS AND METHOD OF ALIGNING PRINTING CYLINDERS DURING A CUTOFF CHANGE

(75) Inventors: Lev Zlatin, Portsmouth, NH (US); Mark Bernard Dumais, Kennebunk, ME (US); Michael Robert Lemelin, Madbury, NH (US)

(73) Assignee: Goss International Americas, Inc., Durham, NH (US)

( * ) Notice: Subject to any disclaimer, the term of this patent is extended or adjusted under 35 U.S.C. 154(b) by 1812 days.

(21) Appl. No.: 12/622,214

(22) Filed: Nov. 19, 2009

(65) Prior Publication Data

US 2010/0126368 A1 May 27, 2010

Related U.S. Application Data

(60) Provisional application No. 61/199,886, filed on Nov. 21, 2008.

(51) Int. Cl.

| | |
|---|---|
| ***B41F 13/36*** | (2006.01) |
| ***B41F 7/04*** | (2006.01) |
| ***B41F 13/32*** | (2006.01) |
| ***B41F 13/40*** | (2006.01) |
| *B41F 13/14* | (2006.01) |
| *B41F 13/26* | (2006.01) |

(52) U.S. Cl.

CPC ..... *B41F 13/36* (2013.01); *B41F 7/04* (2013.01); *B41F 13/32* (2013.01); *B41F 13/40* (2013.01); *B41F 13/14* (2013.01); *B41F 13/26* (2013.01); *B41P 2227/20* (2013.01)

(58) Field of Classification Search

USPC ..... 101/218

See application file for complete search history.

(56) References Cited

U.S. PATENT DOCUMENTS

| | | | | |
|---|---|---|---|---|
| 2,146,963 | A * | 2/1939 | Lang | 101/247 |
| 2,988,989 | A | 8/1958 | Crawford | |
| 3,108,536 | A * | 10/1963 | Harrison | 101/218 |
| 3,323,452 | A * | 6/1967 | Pasquinelli | 101/218 |
| 3,593,662 | A * | 7/1971 | Gates | 101/218 |
| 3,611,924 | A * | 10/1971 | Harrison | 101/98 |

(Continued)

FOREIGN PATENT DOCUMENTS

| | | |
|---|---|---|
| CN | 2518680 Y | 10/2002 |
| CN | 2834907 Y | 11/2006 |
| EP | 1 393 900 A2 | 4/2002 |

*Primary Examiner* — Jill Culler

(74) *Attorney, Agent, or Firm* — Davidson, Davidson & Kappel, LLC

(57) ABSTRACT

A variable cutoff cylinder alignment apparatus is provided. The variable cutoff cylinder alignment apparatus includes a plate cylinder support box for supporting an exchangeable variable cutoff plate cylinder, a blanket cylinder support box for supporting an exchangeable variable cutoff blanket cylinder and an alignment stop adapted to align the blanket cylinder support box and the plate cylinder support box. The plate cylinder support box supports an exchangeable plate cam and the blanket cylinder support box includes a blanket cam. The exchangeable plate cam is capable of contacting the stop and the exchangeable blanket cam is capable of contacting the plate support box to align the blanket cylinder support box and the plate cylinder support box. The plate cylinder support box and the blanket cylinder support box are capable of aligning cylinders of different sized cutoffs. A variable cutoff offset printing press and a method of aligning printing cylinders during a cutoff change are also provided.

20 Claims, 5 Drawing Sheets

(56) References Cited

U.S. PATENT DOCUMENTS

| | | | | |
|---|---|---|---|---|
| 4,138,944 | A * | 2/1979 | Biggar, III | 101/247 |
| 4,458,591 | A * | 7/1984 | Guaraldi | 101/218 |
| 4,462,311 | A * | 7/1984 | Armelin | 101/218 |
| 4,643,090 | A * | 2/1987 | McKrell et al. | 101/218 |
| 5,186,103 | A * | 2/1993 | Gelinas et al. | 101/247 |
| 5,235,910 | A | 8/1993 | Tafel | |
| 5,301,609 | A * | 4/1994 | Guaraldi et al. | 101/247 |
| 5,778,780 | A | 7/1998 | Miller | |
| 2002/0066381 | A1 | 6/2002 | Herda et al. | |
| 2005/0126412 | A1 | 6/2005 | Ruschkowski | |
| 2008/0072776 | A1 | 3/2008 | Kimura et al. | |

* cited by examiner

VARIABLE CUTOFF ALIGNMENT APPARATUS AND METHOD OF ALIGNING PRINTING CYLINDERS DURING A CUTOFF CHANGE

Priority is claimed to U.S. Provisional Application No. 61/199,886 filed Nov. 21, 2008, and hereby incorporated by reference herein.

The present invention relates generally to printing presses and more particularly to a variable cutoff alignment apparatus for a printing press and a method of aligning printing cylinders during a cutoff change.

BACKGROUND

In order to vary a cutoff length of signatures printed by a printing press, plate cylinders, blanket cylinders and impression cylinders may have to be removed from the printing press and replaced with respective cylinders having circumferences that correspond to a new desired cutoff length. Alternatively, each cylinder may include a sleeve that may be removed and replaced with a sleeve having a circumference that corresponds to the new desired cutoff length. Changing cylinders or sleeves may require the mechanisms supporting the cylinders to be separated from one another. After the change, the new cylinders may need to be brought back into contact with one another at a desired position.

SUMMARY OF THE INVENTION

A variable cutoff cylinder alignment apparatus is provided. The variable cutoff cylinder alignment apparatus includes a plate cylinder support box for supporting an exchangeable variable cutoff plate cylinder, the plate cylinder support box including an exchangeable plate cam, a blanket cylinder support box for supporting an exchangeable variable cutoff blanket cylinder, the blanket cylinder support box including an exchangeable blanket cam and an alignment stop for aligning the variable cutoff blanket cylinder and the variable cutoff plate cylinder. The exchangeable plate cam capable of contacting the stop and the exchangeable blanket cam capable of contacting the plate support box to align the variable cutoff blanket cylinder and the variable cutoff plate cylinder for different sized cutoffs.

A method of aligning printing cylinders during a cutoff change is also provided. The method includes the steps of removing a first plate cylinder and a first plate cam from a plate cylinder support box and removing a first blanket cylinder and a first blanket cam from a blanket cylinder support box; mounting a second plate cylinder and a second plate cam on the plate cylinder support box and mounting a second blanket cylinder and a second blanket cam on the blanket cylinder support box; and aligning the second plate cylinder and the second blanket cylinder by contacting an aligning stop with the second plate cam and contacting the plate cylinder support box with the second blanket cam.

A variable cutoff offset printing press is also provided. The variable cutoff offset printing press includes an exchangeable variable cutoff plate cylinder, an exchangeable variable cutoff blanket cylinder, a plate cylinder support box supporting the exchangeable variable cutoff plate cylinder, a blanket cylinder support box supporting the exchangeable variable cutoff blanket cylinder and an alignment stop adapted to align the exchangeable variable cutoff plate cylinder and the exchangeable variable cutoff blanket cylinder. The plate cylinder support box includes an exchangeable plate cam and the blanket cylinder support box includes an exchangeable blanket cam. The exchangeable plate cam is capable of contacting the stop and the exchangeable blanket cam is capable of contacting the plate support box to align the exchangeable variable cutoff blanket cylinder and the exchangeable variable cutoff plate cylinder. The plate cylinder support box and the blanket cylinder support box are capable of aligning cylinders of different sized cutoffs.

BRIEF DESCRIPTION OF THE DRAWINGS

Preferred embodiments of the present invention will be elucidated with reference to the drawings, in which.

DETAILED DESCRIPTION

Figure 1:
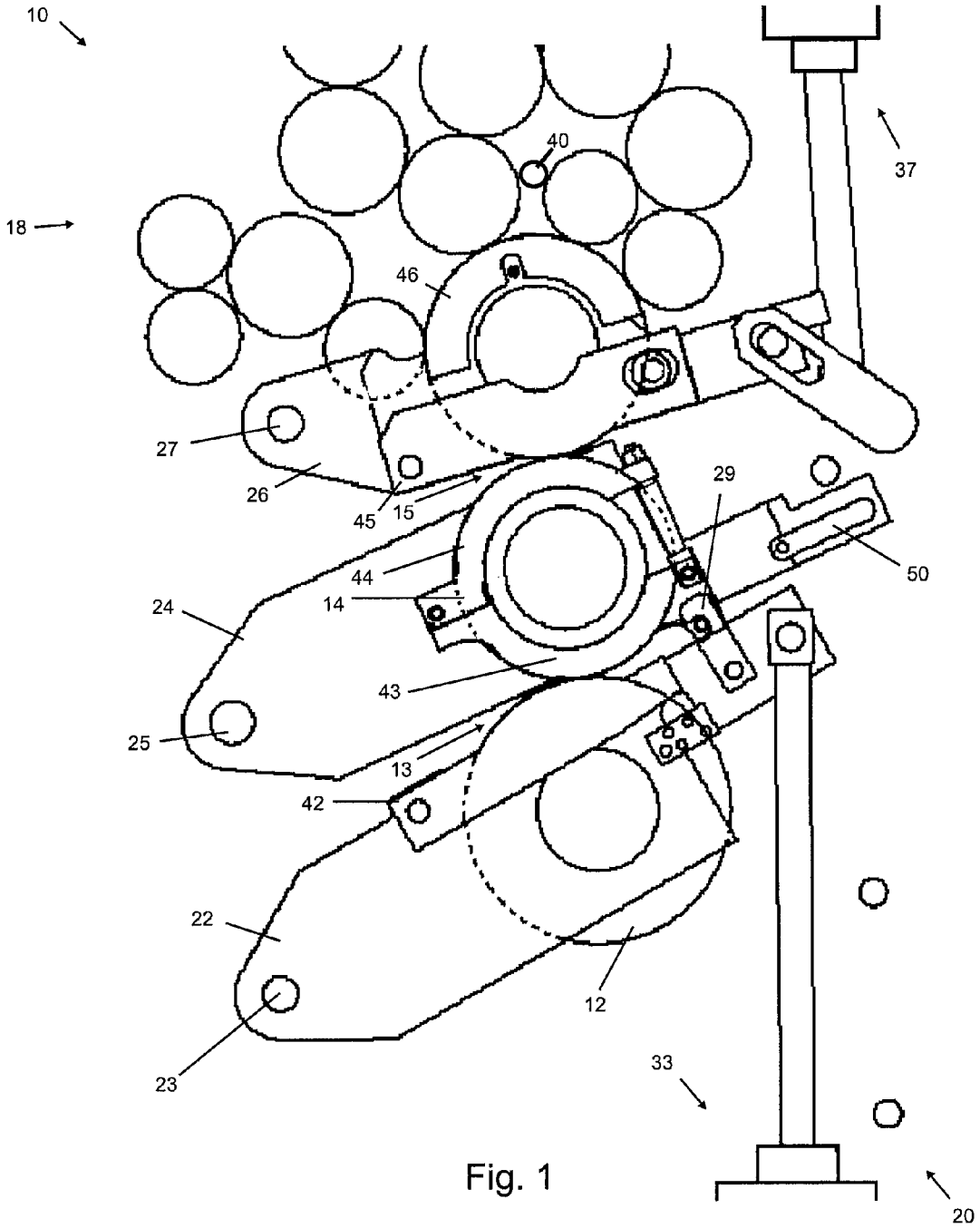
FIG. 1 shows a schematic side view of a printing unit of a printing press arranged in a printing arrangement by a cylinder alignment apparatus according to an embodiment of the present invention.

FIG. 1 shows a schematic side view of a printing unit 10 of a printing press including a cylinder alignment apparatus 20 according to an embodiment of the present invention. The printing press may include multiple printing units. The printing press may include non-perfecting printing units. Each printing unit may print with a different color ink as desired. The printing press may also include a dryer, a folder having a former for folding a web, cutting cylinders and folding cylinders.

Printing unit 10 includes an impression cylinder 12, a blanket cylinder 14, a plate cylinder 16 and an inking and dampening apparatus 18. In operation, inking and dampening apparatus 18 provides ink and dampening solution to plate cylinder 16. Plate cylinder 16, which may be provided with an imaged printing plate mounted thereon, transfers inked images to a printing blanket on blanket cylinder 14 at a nip 15. A printing blanket on blanket cylinder 14 then transfers the images to a web passing between blanket cylinder 14 and impression cylinder 12 at a nip 13.

Cylinder alignment apparatus 20 includes an impression cylinder support box 22 supporting impression cylinder 12, a blanket cylinder support box 24 supporting blanket cylinder 14 and a plate cylinder support box 26 supporting plate cylinder 16. Support boxes 22, 24, 26 are coupled to a supporting frame at respective pivot points 23, 25, 27 on a first side. One a second side, impression cylinder support box 22 is coupled to an actuator 33 and plate cylinder support box 26 is coupled to an actuator 37. Actuators 33, 37 may be pneumatic air cylinders or hydraulic cylinders. An impression cam 42 is coupled to support box 22, first and second blanket cams 43, 44 are coupled to support box 24 and first and second plate cams 45, 46 are coupled to support box 26. An alignment stop 40, which may be coupled to the supporting frame, is near inking and dampening apparatus 18. Alignment stop 40 may be eccentrically mounted on the supporting frame and may be movable between a non-aligning position and an aligning position. In FIG. 1, alignment stop is in the non-aligning position. In the aligning position, alignment stop 40 provides a reference point to assist in aligning support boxes 22, 24, 26 with one another, and thus assists in aligning cylinders 12, 14, 16 with one another. When cylinders 12, 14, 16 are arranged in a printing arrangement, as shown in FIG. 1 for example, impression cam 42 contacts first blanket cam 43, second blanket cam 44 contacts first plate cam 45 and plate cylinder 16 contacts one or more rollers of inking and dampening apparatus 18. Alignment stop 40 is pulled away from second plate cam 46 during printing in the non-aligning position. Support box 22 may be coupled to support box 24 via a latch 29.

Support box 24 may be locked into a set position for a given cutoff, which may be accomplished by be locking support box 24 to the supporting frame via lock mechanism 50. When support box 24 is in the locked position, support box 24 provides a reference point for support boxes 22, 26. Thus, once blanket support box 24 is locked into a desired position for a given printing cutoff, impression cylinder and plate cylinder and their respective support boxes may be thrown on and off as necessary during the printing process, while the blanket cylinder support box remains stationary.

Figure 2:
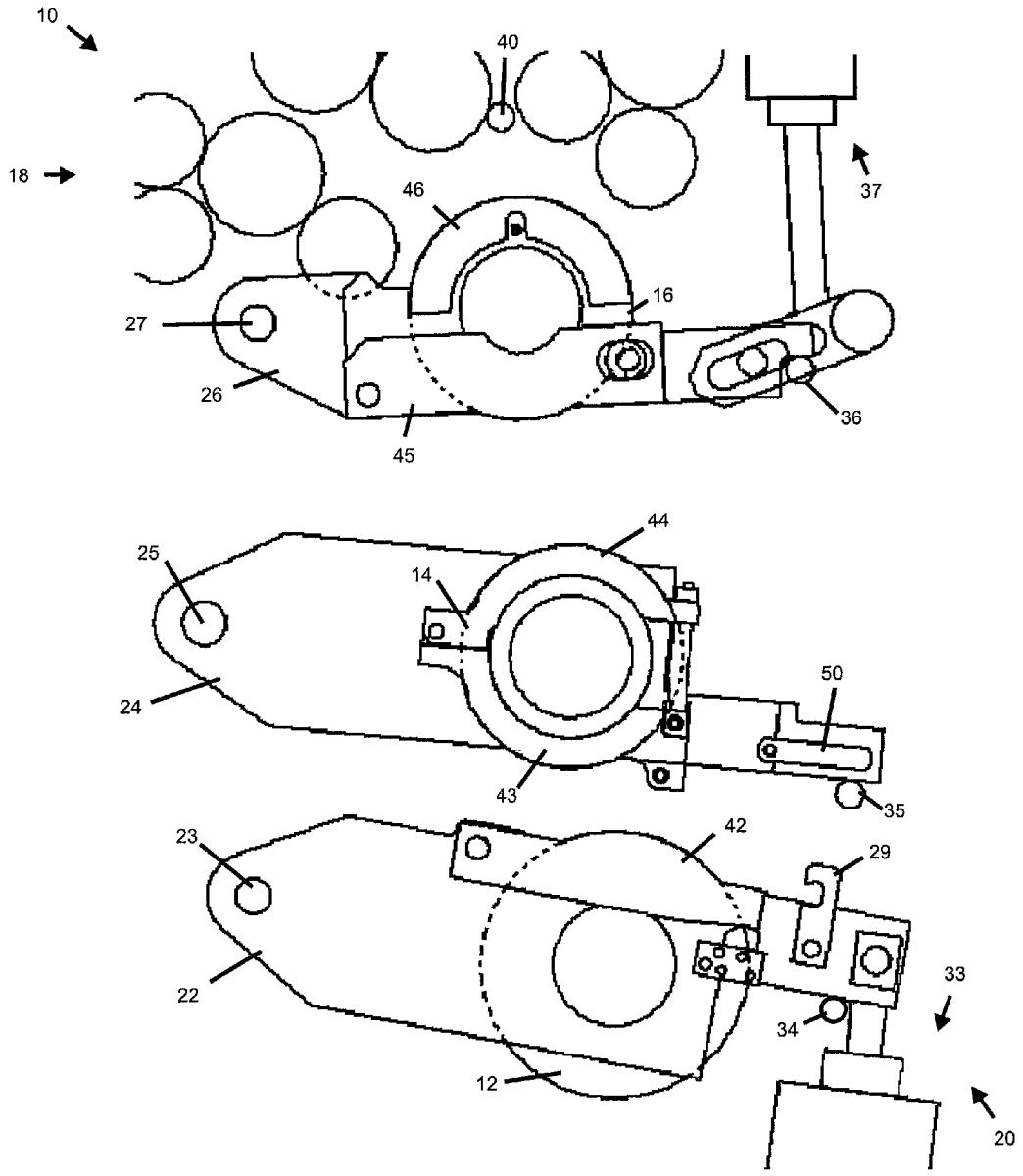
FIG. 2 shows the printing unit shown in FIG. 1 with cylinders of the printing unit in a maximum separation arrangement.

FIG. 2 shows printing unit 10 shown in FIG. 1 with cylinders 12, 14, 16 in a maximum separation arrangement which allows cylinders 12, 14, 16 to be removed for a cutoff change. Sleeves and cams can be changed. Support box 24 is unlocked from the supporting frame via locking mechanism 50 and latch 29 is unlatched from support box 24. Support boxes 22, 24, 26 rest on respective support stops 34, 35, 36. Actuator 37 has moved support box 26 away from alignment stop 40 and inking and dampening apparatus 18. Actuator 33 has moved support box 22 away from support box 24 so that first blanket cam and impression cam 42 are no longer in contact. Support box 24 has moved away from support box 26 so blanket cam 44 and plate cam 45 are no longer in contact. Cylinders 12, 14, 16 (or sleeves of cylinders 12, 14, 16) may then be removed from respective supporting boxes 22, 24, 26, first and second cams 43, 44 may be removed from support box 24 and second cam 46 may be removed from support box 26. Alignment stop 40 is in the non-aligning arrangement.

Figure 3:
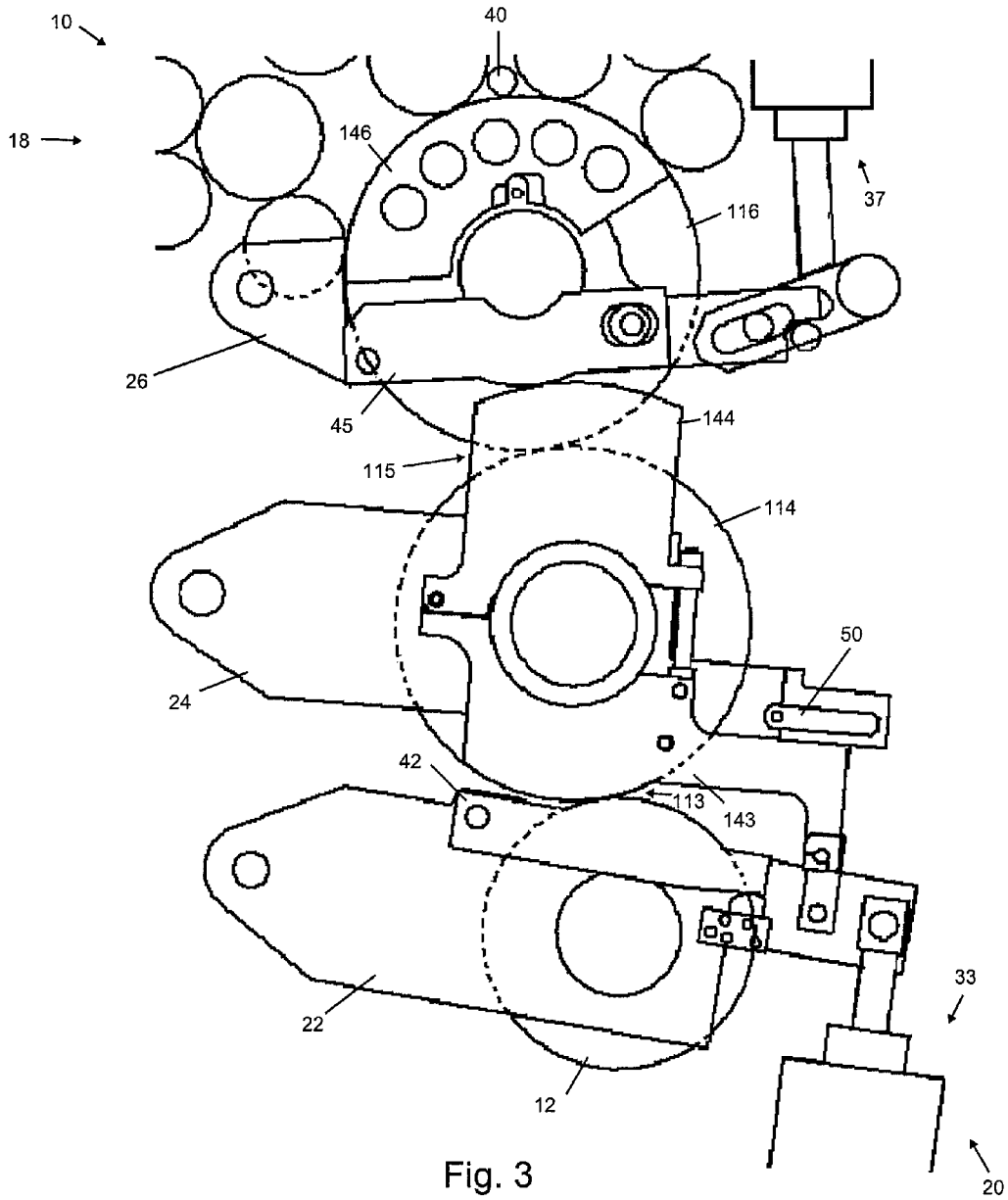
FIG. 3 shows the printing unit shown in FIGS. 1 and 2 including larger plate and blanket cylinders in an aligning arrangement.

FIG. 3 shows printing unit 10 shown in FIGS. 1 and 2 including plate cylinder 116, blanket cylinder 114 and impression cylinder 12. Cylinders 114, 116, 12 are shown in an aligning arrangement and alignment stop 40 is in the aligning position. Cylinders 114, 116 have greater circumferences than cylinders 14, 16 and thus cylinders 114, 116 print images of a larger cutoff than cylinders 14, 16. Blanket cams 43, 44 have been replaced with blanket cams 143, 144 and plate cam 46 has been replaced with a plate cam 146. Cams 143, 144, 146 are radially larger than cams 43, 44, 46. To properly align cylinders 12, 114, 116, cam 146 is brought into contact with alignment stop 40, which is now in a gauging/alignment position for alignment of the cylinders, cam 144 is brought into contact with cam 45, and cam 42 is brought into contact with cam 143. Support box 24 may then be locked into position on the supporting frame via locking mechanism 50 and support boxes 22, 26 may be pushed against support box 24 by contacting cams 143, 144 with cams 42, 45, respectively, to gauge the amount of pressure between cylinders 116, 114 at a nip 115 and the amount of pressure between cylinders 114, 12 at a nip 113. Support box 24 may be locked in place until another cutoff change is required and cylinders 114, 116 (or sleeves on cylinders 114, 116) are replaced.

In situations where some type of maintenance is required, but no change in cutoff is necessary, support box 24 may not need to be moved. If a plate on plate cylinder 116 needs to be replaced, a blanket on blanket cylinder 114 needs to be replaced or impression cylinder 12 needs to be replaced, or any cylinder 12, 114, 116 needs to be repaired, but no cutoff change is required, support box 24 may be left in the locked position. In such an instance, alignment stop 40 may be moved out of the gauging/alignment position and one or more rollers of inking and dampening apparatus 18 may be moved away from plate cylinder 116. Actuator 37 may then move support box 26 away from support box 24 and actuator 33 may move support box 22 away from support box 24. After cylinders 12, 114, 116 are thrown off from one another, the particular maintenance may be performed and it may be unnecessary to gauge the pressure between cylinders 12, 114, 116.

Also, if the web is replaced with web of a different thickness, support box 24 may remain in the locked position and actuator 33 may adjust the position of support box 22 accordingly so that cylinders 12, 114 are correctly positioned with respect to one another.

Blanket cam 144 is sized such that a radius $R_{bc2}$ of blanket cam 144 with respect to a center axis of blanket cylinder 114 is equal to the radius $R_b$ of blanket cylinder 114 plus the difference between the radius $R_p$ of plate cylinder 116 and a radius $R_{pc1}$ of plate cam 45 with respect to a center axis of plate cylinder 116 ($R_{bc2}=R_b+(R_p-R_{pc1})$).

Figure 4:
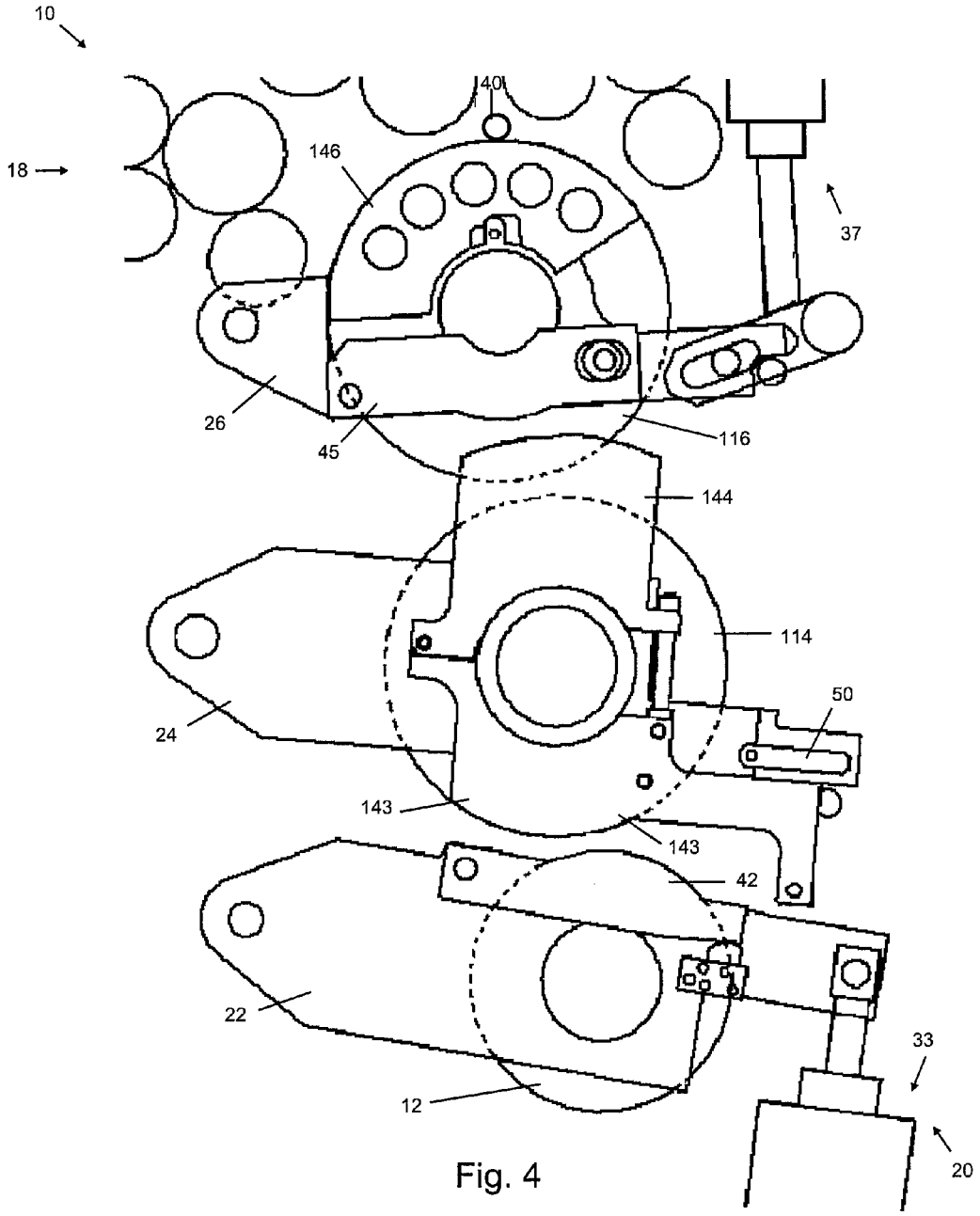
FIG. 4 shows the printing unit shown in FIGS. 3 with the plate cylinder and an impression cylinder in a throw off arrangement.

FIG. 4 shows printing unit 10 shown in FIGS. 3 with plate cylinder 116 and impression cylinder in a throw off arrangement. Both impression cylinder 12 and plate cylinder 116 are thrown off of blanket cylinder 114. Alignment stop 40 is in the non-aligning position. Blanket support box 24 remains in the locked position and plate support box 26 is thrown off of blanket support box 24 by actuator 37 such that plate cam 45 does not contact blanket cam 144 and plate cam 146 comes into contact with alignment stop 40. One or more rollers of inking and dampening apparatus 18 and alignment stop 40 have been moved away from plate cylinder 116. A plate on plate cylinder 116 may be removed and replaced with a replacement plate. In this thrown off arrangement, maintenance operations that do not require a cutoff change may be performed on cylinders 12, 114, 116.

Figure 5:
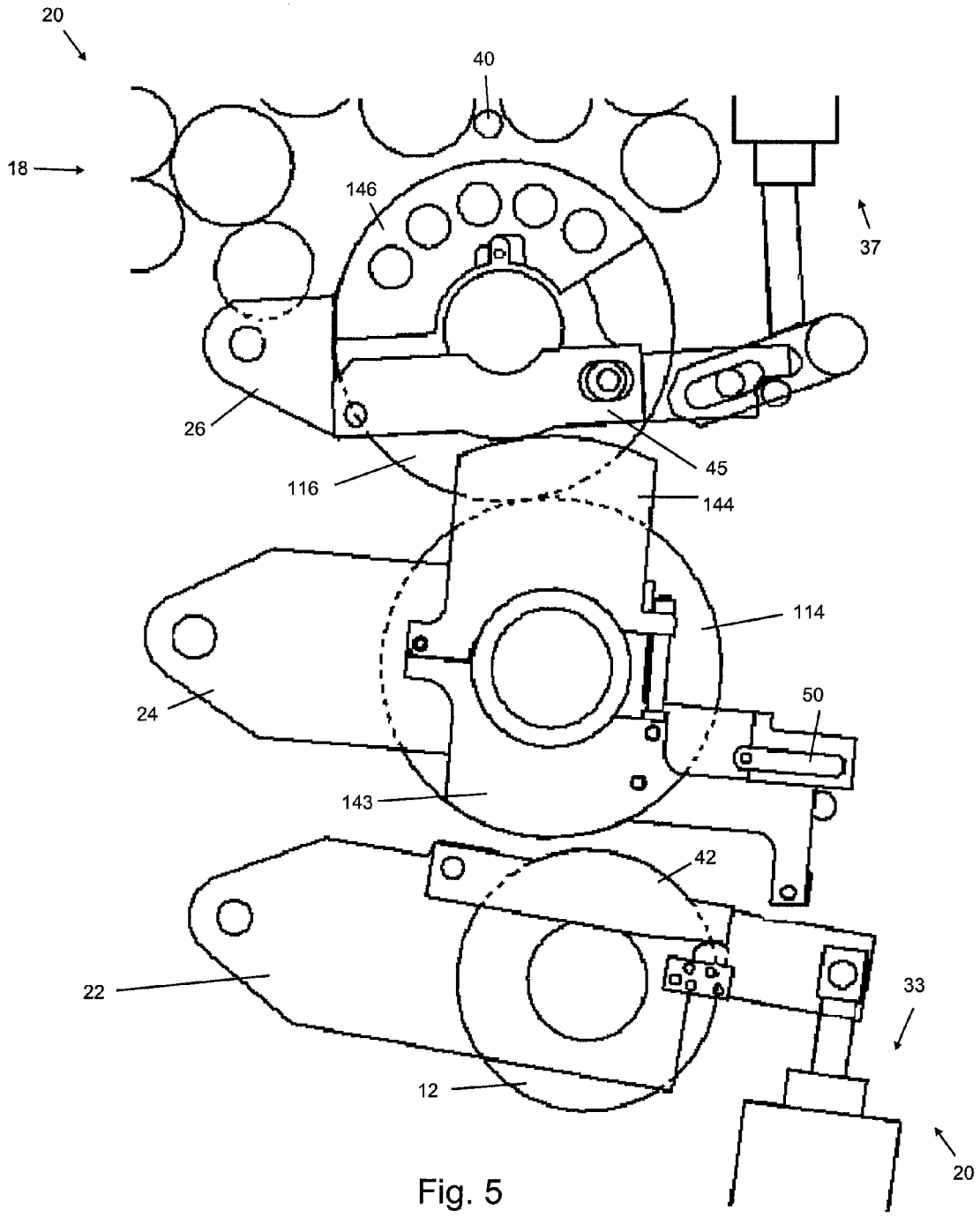
FIG. 5 shows the printing unit shown in FIG. 4 with the plate cylinder in a plating arrangement.

FIG. 5 shows printing unit 10 shown in FIG. 4 in a plating arrangement. Plate cylinder 116 is back into contact with blanket cylinder 114. Plate cylinder 116 is in position for a plating operation and the replacement plate may be secured on plate cylinder 116 by rotating plate cylinder 116 and contacting the replacement plate with blanket cylinder 114. Plate cam 45 is back into contact with blanket cam 144. Alignment stop 10 is in the non-aligning position and is not contacting plate cam 146. After the replacement plate is mounted on plate cylinder 116, the one or more rollers of inking and dampening apparatus 18 may be brought back into contact with plate cylinder 116 and printing unit 10 may resume printing.

In alternative embodiments, blanket cams 43, 44 (FIG. 1) may be replaced by a single cam and blanket cams 143, 144 may be replacement by a single cam.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff cylinder alignment apparatus comprising:

a plate cylinder support box for supporting an exchangeable variable cutoff plate cylinder, the plate cylinder support box including an exchangeable plate cam;

a blanket cylinder support box for supporting an exchangeable variable cutoff blanket cylinder, the blanket cylinder support box including an exchangeable blanket cam; and an alignment stop for aligning the variable cutoff blanket cylinder and the variable cutoff plate cylinder, the exchangeable plate cam capable of contacting the stop and the exchangeable blanket cam capable of contacting the plate support box to align the variable cutoff blanket cylinder and the variable cutoff plate cylinder for different sized cutoffs.

2. The variable cutoff cylinder alignment apparatus as recited in claim 1 wherein the stop can be removed or moved to another position to permit throw-off of the plate cylinder from the blanket cylinder.

3. The variable cutoff cylinder alignment apparatus as recited in claim 1 further comprising a pneumatic cylinder for adjusting a position of the plate cylinder support box.

4. The variable cutoff cylinder alignment apparatus as recited in claim 1 wherein the blanket support box includes a lock, the lock being set after the plate cylinder and blanket cylinder have been aligned, the lock remaining locked for a given cutoff to provide desired positioning of the blanket cylinder.

5. The variable cutoff cylinder alignment apparatus as recited in claim 1 further comprising an impression cylinder support box and a pneumatic cylinder for adjusting a position of the impression cylinder support box.

6. The variable cutoff cylinder alignment apparatus as recited in claim 1 wherein the cutoff can be varied by changing the exchangeable plate cam and the exchangeable blanket cam.

7. The variable cutoff cylinder alignment apparatus as recited in claim 1 further comprising an impression cylinder support box for supporting an impression cylinder, a first actuator for adjusting a position of the plate cylinder support box and a second actuator for adjusting a position of the impression cylinder support box.

8. The variable cutoff cylinder alignment apparatus as recited in claim 1 wherein the exchangeable plate cam is on a first side of the plate cylinder support box and the exchangeable blanket cam contacts the plate cylinder support box on a second side of the plate cylinder support box opposite the first side.

9. The variable cutoff cylinder alignment apparatus as recited in claim 1 wherein the alignment stop is positioned above the plate cylinder support box.

10. The variable cutoff cylinder alignment apparatus as recited in claim 1 further comprising an impression cylinder support box for supporting an impression cylinder, the blanket cylinder support box further including an additional exchangeable blanket cam for contacting the impression cylinder support box.

11. The variable cutoff cylinder alignment apparatus as recited in claim 1 wherein the plate cylinder support box includes an additional plate cam for contacting the exchangeable blanket cam.

12. The variable cutoff cylinder alignment apparatus as recited in claim 1 wherein the exchangeable plate cam has an outer surface having the shape of a circular arc.

13. The variable cutoff cylinder alignment apparatus as recited in claim 1 wherein the exchangeable blanket cam has an outer surface having the shape of a circular arc.

14. The variable cutoff cylinder alignment apparatus as recited in claim 1 further comprising an impression cylinder support box for supporting an impression cylinder and a fastener for removably connecting the blanket cylinder support box to the impression cylinder support box.

15. The variable cutoff cylinder alignment apparatus as recited in claim 1 further comprising a support stop for supporting the plate cylinder support box when the plate cylinder support box is moved away from the alignment stop.

16. The variable cutoff cylinder alignment apparatus as recited in claim 1 wherein the alignment stop is movable radially toward and away from the exchangeable plate cylinder.

17. A method of aligning printing cylinders during a cutoff change comprising:

removing a first plate cylinder and a first plate cam from a plate cylinder support box and removing a first blanket cylinder and a first blanket cam from a blanket cylinder support box;

mounting a second plate cylinder and a second plate cam on the plate cylinder support box and mounting a second blanket cylinder and a second blanket cam on the blanket cylinder support box; and aligning the second plate cylinder and the second blanket cylinder by contacting an alignment stop with the second plate cam and contacting the plate cylinder support box with the second blanket cam.

18. The method as recited in claim 17 further comprising moving one or more rollers of an inking and dampening apparatus into contact with the second plate cylinder after the second plate cylinder contacts the alignment stop.

19. The method as recited in claim 17 further comprising moving the plate cylinder support box away from the alignment stop before removing the first plate cylinder and the first plate cam from the plate cylinder support box.

20. A variable cutoff offset printing press comprising:

an exchangeable variable cutoff plate cylinder;

an exchangeable variable cutoff blanket cylinder;

a plate cylinder support box supporting the exchangeable variable cutoff plate cylinder, the plate cylinder support box including an exchangeable plate cam;

a blanket cylinder support box supporting the exchangeable variable cutoff blanket cylinder, the blanket cylinder support box including an exchangeable blanket cam; and an alignment stop adapted to align the exchangeable variable cutoff plate cylinder and the exchangeable variable cutoff blanket cylinder, the exchangeable plate cam capable of contacting the stop and the exchangeable blanket cam capable of contacting the plate support box to align the exchangeable variable cutoff blanket cylinder and the exchangeable variable cutoff plate cylinder, the plate cylinder support box and the blanket cylinder support box capable of aligning cylinders of different sized cutoffs.

* * * * *